US007547005B2

(12) United States Patent
Tomasel et al.

(10) Patent No.: US 7,547,005 B2
(45) Date of Patent: Jun. 16, 2009

(54) SYSTEM AND METHOD FOR DELIVERING VAPOR

(75) Inventors: Fernando Gustavo Tomasel, Fort Collins, CO (US); Justin Mauck, Fort Collins, CO (US); Juan Jose Gonzalez, Fort Collins, CO (US)

(73) Assignee: Advanced Energy Industries, Inc., Fort Collins, CO (US)

( * ) Notice: Subject to any disclaimer, the term of this patent is extended or adjusted under 35 U.S.C. 154(b) by 578 days.

(21) Appl. No.: 11/355,617

(22) Filed: Feb. 16, 2006

(65) Prior Publication Data

US 2007/0187850 A1 Aug. 16, 2007

(51) Int. Cl.
*B01F 3/04* (2006.01)

(52) U.S. Cl. ..... 261/131; 261/DIG. 65

(58) Field of Classification Search ..... 261/131, 261/141, DIG. 65; 122/14.1
See application file for complete search history.

(56) References Cited

U.S. PATENT DOCUMENTS 3,095,463 A * 6/1963 Chang et al. ..... 165/301
4,276,243 A * 6/1981 Partus ..... 261/128
4,436,674 A * 3/1984 McMenamin ..... 261/64.3
4,582,480 A 4/1986 Lynch
6,644,039 B2 * 11/2003 Hughes et al. ..... 62/49.1
6,970,475 B1 9/2004 Yoo
6,868,869 B2 3/2005 Olander
6,895,178 B2 5/2005 Gu
6,909,839 B2 6/2005 Wang
2001/0035125 A1 11/2001 Talieh et al.
2005/0130445 A1 6/2005 Matsui et al.
2005/0181129 A1 8/2005 Olander
2005/0263075 A1 12/2005 Wang et al.

OTHER PUBLICATIONS

ISA/US, International Search Report, Jan. 5, 2009, USA PCT Office, USA.

* cited by examiner

*Primary Examiner*—Scott Bushey

(57) ABSTRACT

A system and method for providing a vapor are described. In one variation, liquid is placed in a containment vessel, and a pressure in the containment vessel is reduced below atmospheric pressure. The pressure in the vessel is monitored and the liquid is heated in response to the sensed pressure falling below a desired level. When needed, the vapor is delivered from the liquid containment vessel to the external system.

4 Claims, 2 Drawing Sheets

SYSTEM AND METHOD FOR DELIVERING VAPOR

FIELD OF THE INVENTION

The present invention relates to chemical vapor delivery systems. In particular, but not by way of limitation, the present invention relates to systems and methods for delivering a controlled vapor flow of a vaporized liquid.

BACKGROUND OF THE INVENTION

In many processing environments, vapor (e.g., water vapor) is generated and utilized in connection with various processes. In the context of abating undesirable substances that result from fabrication processes (e.g., semiconductor fabrication processes), for example, there have been attempts to implement vapor delivery systems to convert undesirable byproducts to safer compounds for disposal in accordance with environmental guidelines and/or regulations.

As a specific example, water vapor has been utilized in connection with plasma processing devices to convert undesirable perfluorinated gases into relatively harmless components including carbon dioxide. Water vapor for such reactions may be provided by conventional water vapor delivery systems that function under relatively normal pressure conditions to provide water vapor at or above about 100° C. There are several drawbacks to using these conventional water vapor delivery systems. For example, these systems typically require substantial amount of energy, and hence, cost to vaporize water on a large scale.

Another approach to generating vapor includes equipping an evaporation chamber with hot plate evaporators to transfer the heat required to vaporize a liquid. These evaporators, however, are expensive to operate and are typically unable to deliver the volume of vapor needed for effective abatement of undesirable effluents.

An alternate water vapor delivery system uses a water evaporation chamber to heat a larger quantity of water to a temperature high enough to provide vapor on demand in combination with a vapor or gas mass flow controller (MFC), in a vapor feed line, to meter the amount of vapor that is allowed to flow out of the vaporization chamber to a plasma reactor. Although this type of system overcomes some of the drawbacks of the previously described system, it is still necessary to keep the entire system (including a relatively large amount of deionized (DI) water) at a continuously high temperature (e.g. between 90° C. and 140° C.), which drives up thermal costs and introduces safety concerns for workers interacting with such systems.

In yet another approach, low-temperature vapor is generated at sub-atmospheric pressures. Although this approach allows vapor to be generated at low temperatures, the liquid (e.g., water) is prone to freezing, which prevents the generation of vapor. One approach to solving this problem includes monitoring the temperature of the liquid and raising the temperature of the liquid when it approaches the freezing point of the fluid.

Problematically, measuring the temperature at the surface of the liquid, as the liquid is being vaporized, is difficult, and measuring the temperature of the liquid below the surface may not provide an accurate and/or timely measurement of the surface temperature—where the liquid is prone to freezing. Although the liquid may be actively stirred to help ensure the subsurface measurement is accurate, stirring the liquid requires energy and involves mechanical components that require maintenance and are prone to failure.

As a consequence, present devices are functional, but they are not sufficiently accurate or otherwise satisfactory. Accordingly, a system and method are needed to address the shortfalls of present technology and to provide other new and innovative features.

SUMMARY OF THE INVENTION

Exemplary embodiments of the present invention that are shown in the drawings are summarized below. These and other embodiments are more fully described in the Detailed Description section. It is to be understood, however, that there is no intention to limit the invention to the forms described in this Summary of the Invention or in the Detailed Description. One skilled in the art can recognize that there are numerous modifications, equivalents and alternative constructions that fall within the spirit and scope of the invention as expressed in the claims.

In one exemplary embodiment, the present invention may be characterized as a method for delivering a vapor to an external system. The method in this embodiment includes placing a liquid in a containment vessel and reducing a pressure in the containment vessel below atmospheric pressure. In addition, a pressure in the containment vessel is measured and the liquid is heated in response to the sensed pressure falling below a desired level. When desired, vapor from the containment vessel is delivered to the external system.

In another embodiment, the invention may be characterized as a vapor delivery system. In this embodiment, a chamber is adapted to contain a liquid and a vapor from the liquid. The chamber also includes a port configured to couple the chamber to a vacuum so as to enable a pressure in the chamber to be lowered below atmospheric pressure. In addition, the chamber includes a vapor outlet arranged relative to the chamber so as to be capable of exhausting the vapor from the chamber. A pressure sensor is arranged within the chamber to measure the pressure in the chamber and to provide a signal indicative of the pressure. A heater is coupled to the chamber and arranged so as to be capable of imparting heat to the liquid, and a control circuit is coupled to the pressure sensor and the heater. The control circuit in this embodiment is configured to increase an amount of heat imparted to the liquid by the heater in response to the signal indicating a drop in the pressure of the chamber.

In another embodiment, the invention may be characterized as a method for abating undesirable components from a process environment. The method in this embodiment includes placing a liquid in a chamber, which evaporates to form a vapor capable of combining with the undesirable components. The pressure in the chamber is reduced below atmospheric pressure, and a pressure sensor is utilized to sense the pressure in the chamber. In response to the sensed pressure, an amount of heat imparted to the liquid is modulated as a function of the sensed pressure so as to maintain a desirable volume of the vapor in the chamber while maintaining a pressure in the chamber that is below the atmospheric pressure. When demanded, the vapor is delivered to an abatement chamber (e.g., a plasma abatement chamber) where the vapor combines with one or more of the undesirable components to render fewer undesirable components.

As previously stated, the above-described embodiments and implementations are for illustration purposes only. Numerous other embodiments, implementations, and details of the invention are easily recognized by those of skill in the art from the following descriptions and claims.

BRIEF DESCRIPTION OF THE DRAWINGS

Various objects and advantages and a more complete understanding of the present invention are apparent and more readily appreciated by reference to the following Detailed Description and to the appended claims when taken in conjunction with the accompanying Drawings wherein:

DETAILED DESCRIPTION

In accordance with several embodiments, the present invention is directed to a low pressure (e.g., sub atmospheric) vapor delivery system that reliably generates vapor with relatively low energy. In many embodiments for example, vapor is generated at a low pressure without the unreliable, inaccurate and/or costly temperature-controlled vapor generation schemes.

Figure 1:
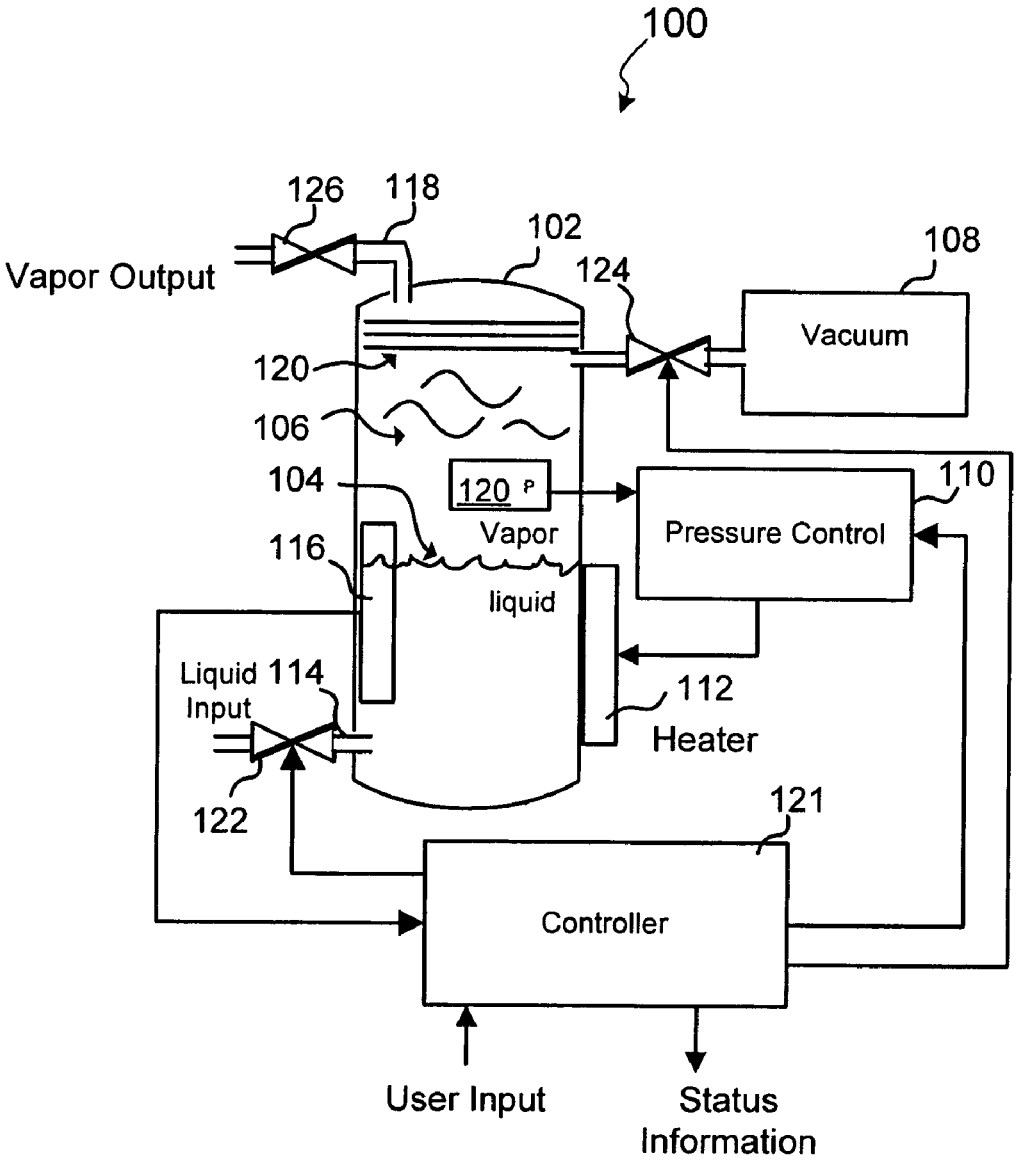
FIG. 1 is a block diagram depicting a vapor delivery system in accordance with an exemplary embodiment of the invention.

Referring now to the drawings, where like or similar elements are designated with identical reference numerals throughout the several views, FIG. 1 is a block diagram depicting a vapor delivery system 100 in accordance with an exemplary embodiment. As shown, the system in this embodiment includes a containment vessel 102 that is configured to contain a liquid 104 (e.g., liquid water) and a vapor 106 (e.g., water vapor) that forms from the liquid. Shown coupled to the containment vessel 102 are a vacuum 108, a pressure controller 110, a heater 112, a liquid input line 114, a liquid level sensor 116 and a vapor outlet 118. As depicted, a pressure sensor 122 is disposed within the vapor 106 of the containment vessel 102 and coupled to the pressure controller 110, which is also coupled to the heater 112. Also shown is a controller 121, which is coupled to the pressure controller 110, the level sensor 116, an input valve 122 of the input line 114 and a vacuum valve 124 for the vacuum 108.

The containment vessel 102 in the exemplary embodiment is a chamber capable of holding the liquid 104 and the vapor 106 under sub-atmospheric pressures while the liquid 104 evaporates to form the vapor 106. In several embodiments, the constituents of the liquid 104 are selected so as to generate a vapor that includes components that have an affinity for reacting with undesirable effluents of an industrial process. In one embodiment for example, the liquid 104 is water, and the water vapor that forms is useful for abating undesirable components (e.g., perfluorinated gases) from a semiconductor manufacturing process.

The vacuum 108 in the exemplary embodiment is a vacuum line from a vacuum utilized in connection with a fabrication process (no shown), and the vacuum valve 124 is configured to open and close so as to provide low pressure to the containment vessel 102 as described further herein.

The pressure controller 110 in this embodiment is configured to receive, from the pressure sensor 120, a pressure signal, which is indicative of the vapor pressure in the containment vessel 102. In response to the pressure signal, the pressure controller 110 sends a control signal to the heater 112, which controls the operation of the heater 112. In some embodiments the pressure sensor 120 is realized by a strain gauge pressure sensor, and in other embodiments, a capacitive pressure sensor is utilized. In yet other embodiments, however, other varieties of pressure sensors may be utilized. In many embodiments, the pressure controller 140 is a proportional, integral, and differential (PID) controller, but this certainly not required and other types of control schemes are contemplated and well within the scope of the present invention.

Beneficially, the pressure sensor 120 enables the fluid delivery system 100 to react faster and/or more accurately than systems that attempt to control the environment in a containment vessel with a temperature feedback system. In a typical temperature controlled system, for example, it is desirable to monitor the temperature of the liquid at the surface of the liquid because the surface is the where the liquid is prone to becoming a solid (e.g., ice). The surface of the liquid, however, drops as the liquid evaporates and rises as more liquid is introduced, which makes surface temperature measurements difficult. As a consequence, some temperature-controlled systems submerse a temperature sensor below the surface of the liquid. This approach, however, does not consistently provide an accurate view of the surface temperature of the liquid, and although stirring may be employed in an attempt to homogenize the temperature of the liquid, stirring requires energy and introduces mechanical aspects into the system, which are prone to failure-even if properly maintained.

The heater 112 in the exemplary embodiment is thermally coupled to the liquid 104 to enable the heater 112 to transfer heat to the liquid 104. The heater 112 in many embodiments is realized by an external, electric heater blanket, but this is certainly not required, and in other embodiments the heater is realized by a submersible heater placed within the liquid 104 inside of the vessel 102. As discussed further herein, the rate at which the liquid 104 evaporates and the pressure of the vapor 106 are proportional to the amount of energy imparted to the liquid 104 by the heater 112.

As depicted in FIG. 1, the liquid level sensor 116 is disposed within the containment vessel 102 and arranged to provide a liquid-level signal to the controller 121 in response to the liquid level falling below a desired level. In one embodiment, the liquid level sensor 116 is realized by floats in the liquid 104, which are magnetically coupled to reed switches. In one variation, for example, two sets of floats are utilized—one float set to sense a maximum liquid volume and another set to sense a minimum liquid volume. One of ordinary skill in the art, having the benefit of this disclosure, will appreciate that other level sensors may be utilized as well.

As shown, the controller 121 in this embodiment is configured to receive the liquid-level signal (e.g., a low level signal or a high level signal) from the level sensor 116, and provide a level-control signal to the input valve 122. In addition, the controller 121 in this embodiment is configured to receive input (e.g., command and set point information) from a user and provide status information back to the user. In addition, the controller 121 in this embodiment is coupled to the pressure controller 110 to enable the controller 121 to convey information (e.g., set point information) to the pressure controller 110.

The controller 121 in some embodiments is realized by hardware, and in other embodiments is realized by a combination of hardware and firmware (e.g., a processor executing instructions stored in non-volatile memory. It should be recognized that the controller 121 and the pressure controller 110 are depicted as separate elements merely for purposes of describing functional components of the exemplary embodiment, and that the functions carried out by the controller 121 and the pressure controller 110, in some embodiments, are carried out by a unitary controller.

As depicted, an output valve 126 enables a user to deliver vapor from the chamber, via the vapor outlet line 118, to a desired location. In some implementations for example, the output valve 126 couples the vapor outlet line 118 to an abatement system where the vapor is mixed with undesirable components and processed in a plasma chamber.

As shown, the containment vessel 102 in the exemplary embodiment includes baffles 128 that are disposed between the liquid 104 and the vapor outlet 118 and are arranged to reduce the amount of any liquid that may splash into the vapor output line 118 while fresh liquid (e.g., liquid containing entrained air) is degassed in the low pressure environment of the containment vessel 102. In some variations, to prevent condensation, the vapor outlet 118 is heated (e.g., by a resistive element), not shown.

Figure 2:
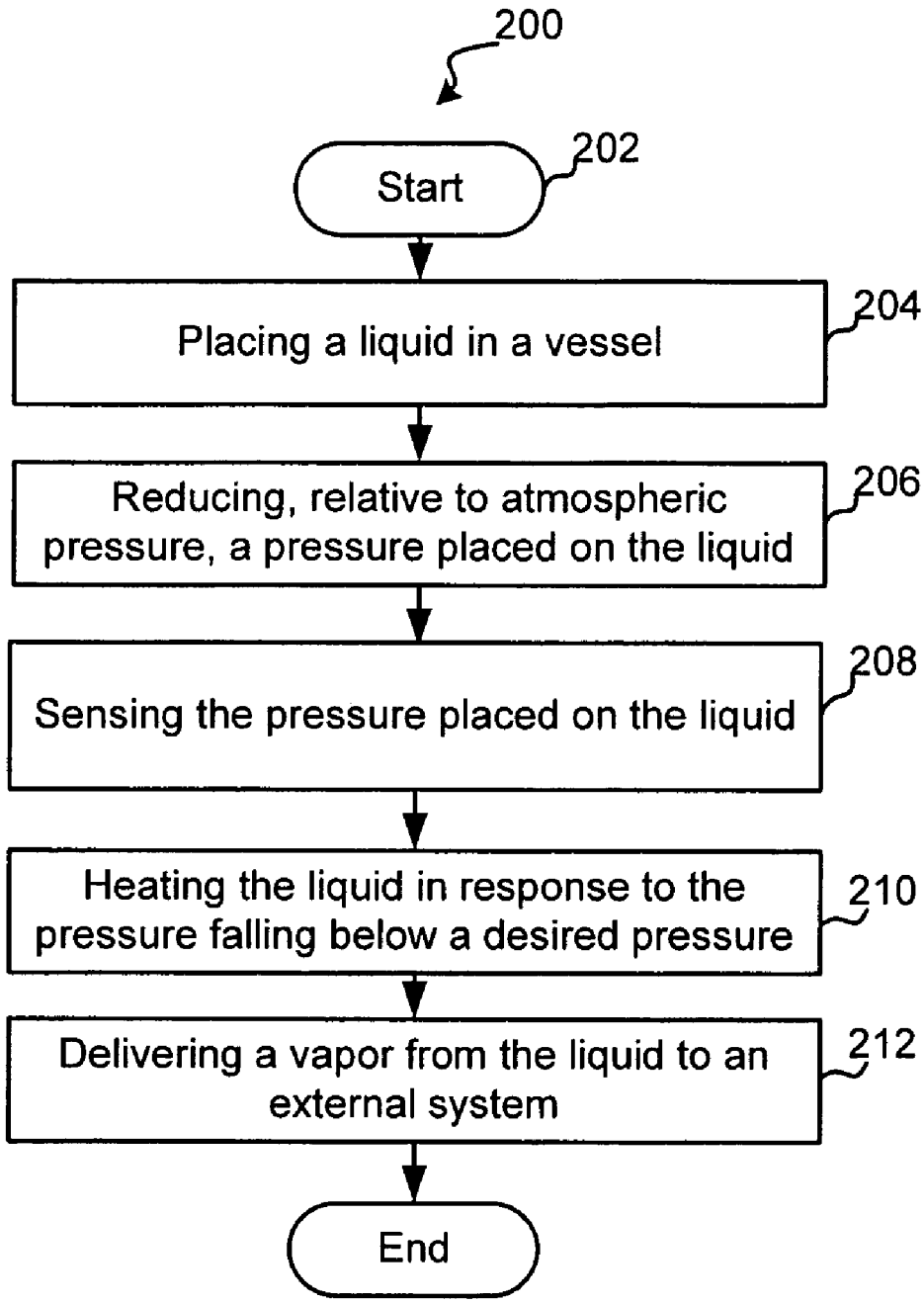
FIG. 2, is a flowchart depicting a method for delivering vapor in accordance with several embodiments.

Referring next to FIG. 2, shown is a flowchart depicting a method for delivering vapor in accordance with several embodiments of the present invention. While referring to FIG. 2, reference will be made to FIG. 1, but it should be recognized that the method described herein with reference to FIG. 2 is not limited to the specific embodiment previously described with reference to FIG. 1.

As shown, liquid is initially placed in a containment vessel (Blocks 202, 204) and the pressure in the vessel is reduced to a sub-atmospheric pressure (Block 206). In several embodiments, for example, the pressure in the vessel is reduced to a pressure between 35 and 150 Torr, and in one particular embodiment, the pressure is reduced to about 50 Torr.

As depicted in FIG. 2, once liquid occupies the vessel, the vapor pressure in the vessel is sensed with a pressure sensor (e.g., the pressure sensor 120)(Block 208). In many embodiments, the pressure is continually measured to provide almost instantaneous information about the state of the vapor, and hence, the state at the surface of the of the liquid. In particular, the physical state of the liquid is readily determinable based upon the measured vapor pressure in the vessel. As a consequence, in many embodiments the set point of the pressure controller (e.g., the pressure controller 121) is established so that the state of the liquid renders an optimal level of evaporation.

As shown in FIG. 2, when the pressure of the vapor falls below a desirable level, the liquid is heated to return the vapor pressure back into within a desirable range of operating pressures (Block 210). In this way, the liquid is maintained under a range of sub-atmospheric pressures that induce the liquid to evaporate with relatively little energy.

When demanded, the vapor is delivered from the containment vessel to an external system (e.g., an abatement system) (Block 212), and the evaporation of the liquid replenishes the vapor in the vessel. Beneficially, utilization of a pressure sensor (e.g., pressure sensor 120) enables variations in the monitored vapor pressure to be quickly sensed so that when a user is removing vapor from the containment vessel in a pulse-like manner, the pressure controller is able to immediately send a signal to the heater to respond to the sudden drops in the vapor pressure.

In conclusion, the present invention provides, among other things, a system, apparatus and method for delivering vapor. In several variations, vapor is generated in a low pressure environment, and the pressure of the vapor is measured and maintained with a pressure control system. In this way, vapor is quickly, efficiently and reliably delivered when needed. Those skilled in the art can readily recognize that numerous variations and substitutions may be made in the invention, its use and its configuration to achieve substantially the same results as achieved by the embodiments described herein. Accordingly, there is no intention to limit the invention to the disclosed exemplary forms. Many variations, modifications and alternative constructions fall within the scope and spirit of the disclosed invention as expressed in the claims.

What is claimed is:

1. A vapor delivery system, comprising:

a chamber adapted to contain a liquid and a vapor from the liquid, wherein the chamber includes a port configured to couple the chamber to a vacuum so as to enable a pressure in the chamber to be lowered below atmospheric pressure;

a vapor outlet arranged relative to the chamber so as to be capable of exhausting the vapor from the chamber;

a pressure sensor within the chamber and arranged outside of the liquid to measure the pressure in the chamber, wherein the sensor is configured to provide a signal indicative of the pressure in the chamber;

a heater coupled to the chamber and arranged so as to be capable of imparting heat to the liquid; and a control circuit coupled to the pressure sensor and the heater, wherein the control circuit is configured to increase an amount of heat imparted to the liquid by the heater in response to the signal indicating a drop in the pressure of the chamber.

2. The system of claim 1, wherein the control circuit is a proportional integral derivative (PID) control circuit.

3. The system of claim 1, wherein the liquid is liquid water and the vapor is water vapor.

4. The system of claim 1, wherein the chamber includes baffles configured and arranged so as to be capable of reducing an amount of the liquid that enters the vapor outlet.

* * * * *